US007377102B2

(12) United States Patent
Roach et al.

(10) Patent No.: US 7,377,102 B2
(45) Date of Patent: May 27, 2008

(54) DEVICE AND METHOD FOR HEATING EXHAUST GAS

(75) Inventors: Michael Roach, Santa Fe, NM (US); Michael Tripodi, Santa Fe, NM (US); William Tilton, Santa Fe, NM (US)

(73) Assignee: CleanAir Systems, Santa Fe, NM (US)

( * ) Notice: Subject to any disclaimer, the term of this patent is extended or adjusted under 35 U.S.C. 154(b) by 301 days.

(21) Appl. No.: 11/201,744

(22) Filed: Aug. 11, 2005

(65) Prior Publication Data

US 2007/0056263 A1 Mar. 15, 2007

(51) Int. Cl.
*F01N 3/00* (2006.01)

(52) U.S. Cl. ..... 60/284; 60/274; 60/286; 60/295; 60/297; 60/300; 60/303; 60/324; 422/172; 422/182; 422/183

(58) Field of Classification Search ..... 60/274, 60/284, 286, 295, 297, 303, 324, 300; 422/171, 422/172, 177, 182, 183
See application file for complete search history.

(56) References Cited

U.S. PATENT DOCUMENTS

| | | | | |
|---|---|---|---|---|
| 4,054,418 | A * | 10/1977 | Miller et al. | 422/171 |
| 4,345,431 | A | 8/1982 | Suzuki et al. | |
| 4,571,938 | A | 2/1986 | Sakurai | |
| 4,651,524 | A | 3/1987 | Brighton | |
| 4,662,172 | A | 5/1987 | Shinzawa et al. | |
| 4,955,183 | A | 9/1990 | Kolodzie et al. | |
| 4,991,396 | A | 2/1991 | Goerlich et al. | |
| 5,001,899 | A | 3/1991 | Santiago et al. | |
| 5,014,511 | A * | 5/1991 | Wade et al. | 60/303 |
| 5,038,562 | A | 8/1991 | Goerlich | |
| 5,082,478 | A * | 1/1992 | Oono et al. | 55/466 |
| 5,105,621 | A | 4/1992 | Simmons et al. | |
| 5,395,600 | A * | 3/1995 | Cornelison | 422/18 |
| 5,465,574 | A * | 11/1995 | Ma | 60/300 |
| 5,711,149 | A * | 1/1998 | Araki | 60/278 |
| 5,826,428 | A | 10/1998 | Blaschke | |
| 6,003,305 | A * | 12/1999 | Martin et al. | 60/274 |
| 6,516,610 | B2 * | 2/2003 | Hodgson | 60/286 |
| 6,694,727 | B1 | 2/2004 | Crawley et al. | |
| 7,104,358 | B2 * | 9/2006 | Frederiksen | 181/249 |

FOREIGN PATENT DOCUMENTS

| | | |
|---|---|---|
| DE | 1 625 770 | 8/1970 |
| DE | 30 13 024 | 10/1981 |
| GB | 775525 | 5/1957 |
| GB | 897014 | 5/1962 |

* cited by examiner

*Primary Examiner*—Tu M. Nguyen
(74) *Attorney, Agent, or Firm*—Robert W. Becker; Robert W. Becker & Assoc.

(57) ABSTRACT

A device and method for heating exhaust gas from the combustion of fossil fuel upstream of an emissions control device, especially a diesel particulate filter. A conduit receives an exhaust gas flow, and is in fluid communication with the emissions control device for supplying exhaust gas thereto. A flow straightener is disposed in the conduit, and a portion of the exhaust gas flows through the flow straightener. An igniter is disposed in the conduit between the flow straightener and the emissions control device for igniting fuel supplied thereto to produce a flame to heat the exhaust gas flow.

16 Claims, 2 Drawing Sheets

DEVICE AND METHOD FOR HEATING EXHAUST GAS

BACKGROUND OF THE INVENTION

The present application relates to a device and method for heating exhaust gas from the combustion of fossil fuel upstream of an emissions control device.

It is an object of the present application to provide an improved device and method for heating exhaust gas to achieve combustion or conversion of matter that has collected in a particulate filter or other emissions control device disposed in an exhaust system of an internal combustion engine or other fossil fuel burning device, without the need for a separate combustion or conversion chamber.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
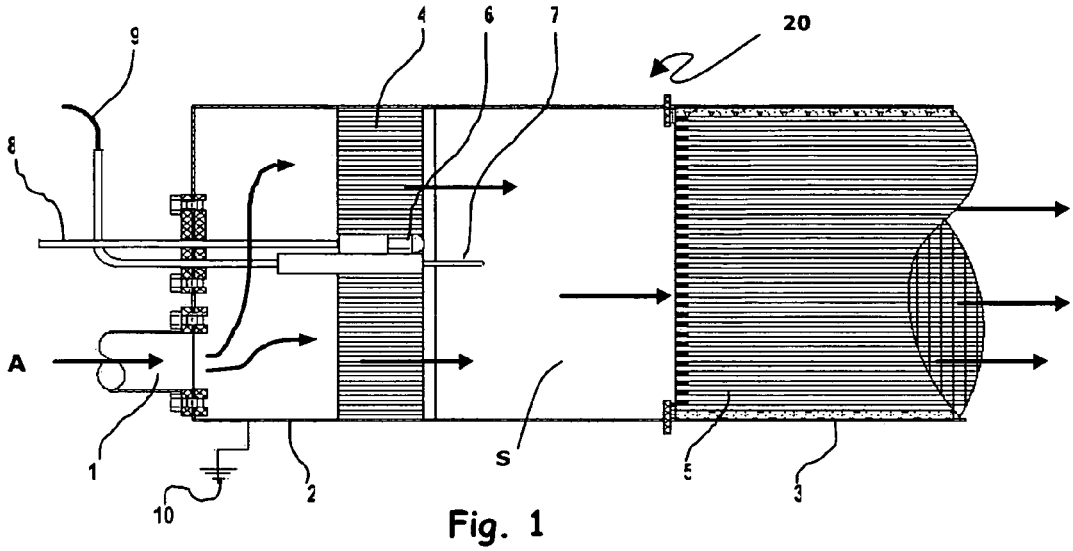
FIG. 1 illustrates one exemplary embodiment of a device for heating exhaust gas.

The device of the present application comprises a conduit that receives an exhaust gas flow and is in fluid communication with the emissions control device; a flow straightener is disposed in the conduit, and at least a portion of the exhaust gas flow flows through the flow straightener; an ignition means is disposed in the conduit between the flow straightener and the emissions control device for igniting fuel supplied to the vicinity of the ignition means to produce a flame to heat the exhaust gas flow; no secondary supply of gas that contains oxygen is provided to the exhaust gas flow or to the conduit.

The heat transferred to the exhaust gas and to the emissions control device, such as a Selective Catalytic Reduction (SCR) device, an $NO_x$ adsorber or device, or a particulate filter, heats the filter to a temperature to or above the combustion temperature of particulate matter collected in the filter or the device to or above the conversion temperature of matter collected in the emissions control device. Even when supply of fuel and production of a flame has been terminated, residual heat stored in the particulate filter or the device continues to promote passive regeneration thereof.

The entire exhaust gas flow from a combustion device, such as an internal combustion engine, passes through the device of the present application. No separate ignition chamber is required. Therefore, since the entire exhaust gas flow passes through the device or burner, an intimate contact is achieved between the flame and the exhaust gas. This results in a high, uniform heating of the exhaust gas without the need of complex flow enhancers to promote mixing. As a matter of fact, rather than providing mixing, a flow straightener is provided to decrease turbulence in the exhaust gas flow, to eliminate flame blow-out, and to create a slight positive pressure gradient. Thus, the flow straightener stabilizes the exhaust gas flow and enables it to support a flame.

Flow diverters or baffle arrangements, or a combination of such devices and a flow straightener, can be used instead of a single flow straightener.

Further specific features of the present application will be described in detail subsequently.

DESCRIPTION OF SPECIFIC EMBODIMENTS

The device of the present application for heating exhaust gas, also known as an exhaust gas burner, will now be explained in connection with a particulate filter, either catalyzed or non-catalyzed, as the emissions control device. The device of the present application for heating exhaust gas is generally indicated in the drawings by the reference numeral 20, and is used, for example, in the exhaust system of an internal combustion engine, such as a diesel engine, as is shown in conjunction with FIG. 3 and will be described in greater detail subsequently. It is, of course, to be understood that the device of the present application could be used for any other system where it is necessary to heat exhaust gas produced from the combustion of fossil fuel upstream of an emissions control device for the purpose of achieving combustion or conversion of matter that has collected in a particulate filter or other emissions control device disposed in an exhaust system of an internal combustion engine or other fossil fuel burning device.

Referring now to the drawings in detail, FIG. 1 shows one exemplary embodiment of the inventive device 20 for heating exhaust gas.

Exhaust gas A, for example from an internal combustion engine, flows via the conduit 1 into the device 20. In particular, the exhaust gas A flows into the larger conduit 2, where it expands. Subsequently, the exhaust gas flows through the flow straightener 4, as indicated by the arrows. The purpose of the flow straightener 4 is to prevent turbulence that could adversely affect the formation of a flame that is to be produced by burning later-to-be-introduced fuel, as will be discussed in detail subsequently in conjunction with the activation of the device of the present application. The flow straightener 4 is therefore provided with a plurality of parallel cells or channels, for example 10-900 channels per square inch (cpsi). By way of example only, the flow straightener 4 can have approximately 400 cpsi, and in the direction of flow can have a depth of 2 inches. However, any other cpsi or depth that is suitable to produce a laminar flow for a given application would also be possible. The flow straightener 4 is, for example, a substrate made of ceramic, metal, or sintered metal. Any appropriate shape can be used for the channels of the flow straightener 4. For example, the channels can have a square, circular or even triangular cross-sectional configuration. In addition, the flow straightener 4 can be honeycombed, or can have a corrugated configuration, in other words, the flow straightener can be formed by wrapping or winding a sheet of material containing channels until a flow straightener of desired size is formed. At any rate, the shape and number of channels in the flow straightener 4 should be such as to allow adequate flow through the flow straightener to prevent back pressure upstream thereof.

Disposed downstream of the flow straightener 4 is an emissions control device 5, in the illustrated embodiment in the form of a particulate filter. The emissions control device 5 is disposed in a conduit 3 that is in fluid communication with the conduit 2 so that the conduit 3, and hence the particulate filter 5, can receive exhaust gas from the conduit 2. The diameter of the conduit 3 is approximately the same as the diameter of the conduit 2.

When the build-up of particulate matter in the particulate filter 5 is such that flow therethrough is affected, thereby producing, for example, a back pressure in the conduit 2 and/or in the conduit 1 that can be sensed, the operation of the device of the present application is activated in order to further heat the exhaust gas in order to achieve conversion of the matter that has collected in the emissions control device 5, and in the illustrated embodiment in particular to achieve combustion of particulate matter that has collected in the filter 5.

In particular, at pre-determined time periods or control settings, for example based on time, temperature or pressure, the ignition means 7, such as a glow stick igniter, glow plug, or spark igniter, is electrically heated by applying an electric current thereto via the wire 9. The device should be grounded as indicated by the reference numeral 10. After the igniter 7 glows red or has otherwise reached an adequate temperature, for example after a pre-determined time (e.g. six seconds) or as a function of some other control setting, fuel, such as diesel fuel, is introduced via the tube or fuel feed line 8 to a fuel supply means 6, such as a nozzle, that, just like the igniter 7, is disposed in or communicates with the space S disposed between the flow straightener 4 and the particulate filter 5. Where the fuel supply means 6 is in the form of one or more nozzles 6, the fuel is atomized and is ignited by the one or more igniters 7 to produce a flame that then heats the exhaust gas A for the purpose of regenerating the particulate filter 5 by producing combustion of the particulate matter collected therein. After regeneration of the filter is complete, and the igniter is turned off or about to be turned of, the supply of fuel to the fuel supply means 6 can actually be reversed, e.g. by reversing the pump 12 (see FIG. 3); This reversal can suck out excess fuel to reduce any unwanted emissions that could otherwise be generated.

Although activation of the device of the present application for heating exhaust gas has been described in conjunction with the build-up of particulate matter in the filter 5, the device can also be activated when other parameters or threshold values are present. For example, the device could be activated after the passage of a given number of minutes, or if the temperature in the system has dropped below a threshold temperature. It should also be noted that supply of fuel to the vicinity of the igniter, and heating of the igniter itself, are terminated when the exhaust gas has been heated to the temperature desired for burning of the particulate matter in the filter 5. In addition, the device of the present application is preferably activated while the engine is idling, although this would not be necessary in all conditions.

Although in the illustrated embodiment the conduit 1 is connected to the bottom of the upstream end of the conduit 2, the conduit 1 could be connected to the top of the conduit 2, or to the sides thereof.

Figure 2:
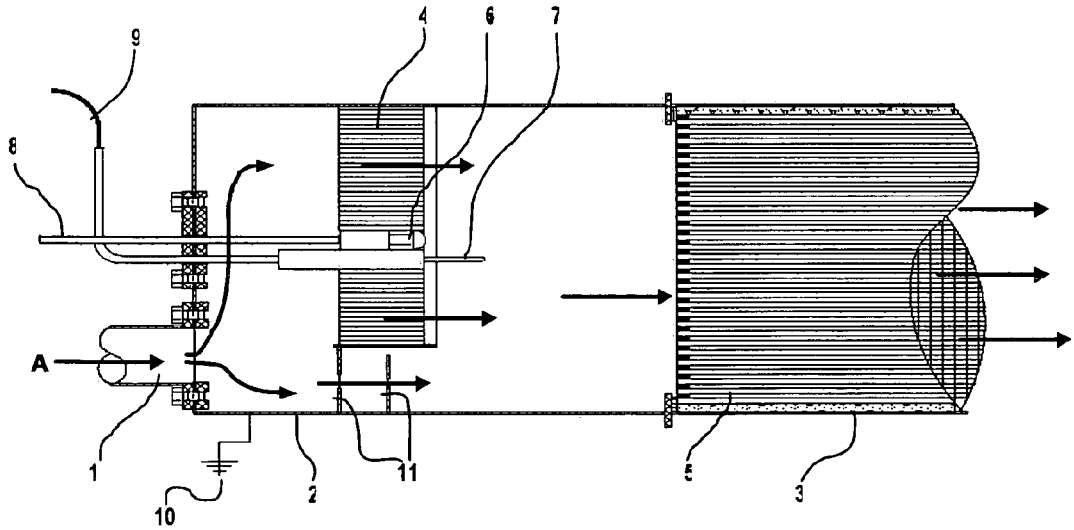
FIG. 2 shows a modified embodiment of the device of FIG. 1.

Another exemplary device for heating exhaust gas pursuant to the present application is illustrated in FIG. 2. To the extent that the same or comparable components are illustrated, the same reference numerals are utilized.

The embodiment of FIG. 2 differs from that of FIG. 1 in that instead of extending over the entire cross section of the conduit 2, the flow straightener 4 extends across only a portion of the conduit 2. As can be seen below the flow straightener 4 in the depiction of FIG. 2, a baffle arrangement is provided. The purpose of this baffle arrangement is to have some of the exhaust flow go around the flow straightener 4 so that less back pressure is produced. However, it should be noted that the baffle arrangement 11 should also have a configuration such that it acts as a flow straightener. In other respects, the embodiment of FIG. 2 operates in the manner described in conjunction with the embodiment of FIG. 1.

Figure 3:
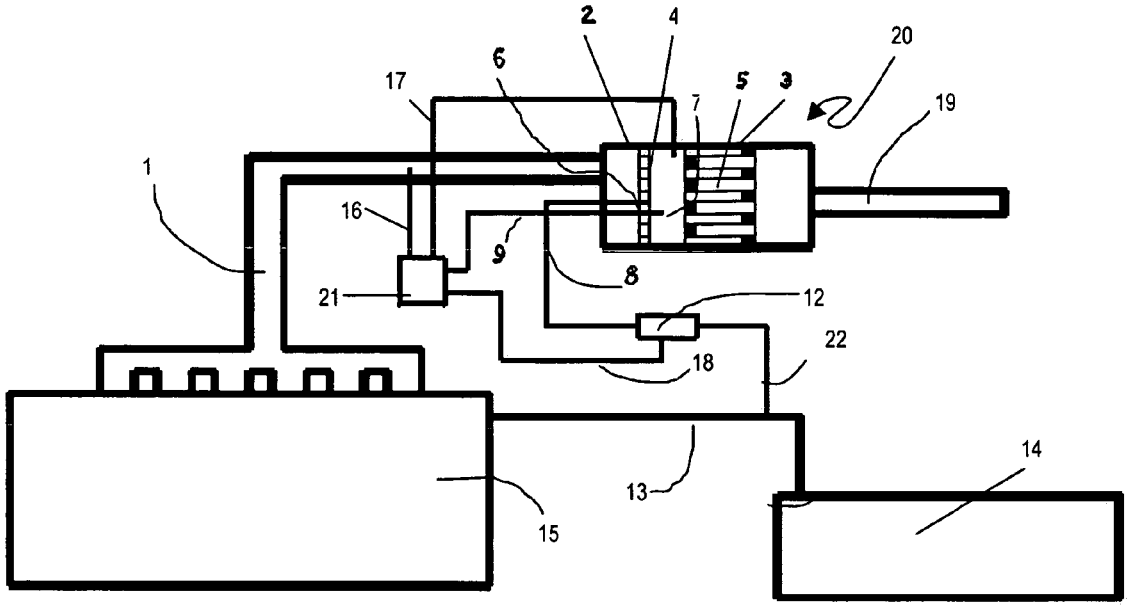
FIG. 3 shows an inventive device in an exemplary exhaust system.

Reference is now made to FIG. 3, which shows the device of the present application disposed in an exhaust system of an internal combustion engine.

Fuel from the fuel tank 14 is delivered via the fuel line 13 to the engine 15. Exhaust gas produced by the combustion of fuel in the engine 15 flows through the conduit 1 and enters the conduit 2 of the device 20 in the manner previously described. Sensor lines 16 and 17 provide information regarding, for example, exhaust back pressure and temperature respectively to a control unit 21 for processing such information in order to determine when to begin heating of the exhaust gas in the device 20 by energizing the igniter 7. The control unit 21 sends a signal at the appropriate time via the signal line 18 to the pump 12, which then supplies fuel via the fuel feed line 8 to the vicinity of the hot igniter 7, as described above. The pump 12 draws fuel from the fuel tank 14 via the fuel line 13 and then the fuel line 22. The pump 12 can, for example, be a multi-stage or variable-drive pump that coordinates with the volume of the exhaust gas flow. Exhaust gas that has passed through the device 20 passes, for example, to the atmosphere via the conduit 19.

It is to be understood that the fuel being supplied to the device 20, and in particular to the nozzle or fuel supply means 6, could be pre-heated prior to reaching the nozzle 6, for example via heat exchange with the conduit 1.

The present invention is, of course, in no way restricted to the specific disclosure of the specification and drawings, but also encompasses any modifications within the scope of the appended claims.

We claim:

1. A method for heating exhaust gas from the combustion of fossil fuel upstream of an emissions control device, including the steps of:

causing at least a portion of said exhaust gas to flow through a flow straightener disposed in a conduit upstream of said emission control device, wherein said flow straightener is provided with a plurality of parallel channels and extends over a portion of a cross-sectional area of said conduit, and wherein a baffle arrangement is disposed between said flow straightener and a wall of said conduit;

heating an ignition means disposed between said flow straightener and said emissions control device; and supplying fuel to the vicinity of said ignitions means for ignition of said fuel, using only oxygen present in said exhaust gas, to produce a flame to heat said exhaust gas.

2. A method according to claim 1, wherein said step of supplying fuel for ignition is quickly reversed at the conclusion of a heating cycle to reduce unwanted emissions that can be generated at this time.

3. A method according to claim 1, wherein said step of supplying fuel comprises supplying fuel via a multi-stage or variable-drive pump that coordinates with a volume of said exhaust gas.

4. A method according to claim 1, wherein said exhaust gas is produced by a combustion device, and wherein all of said exhaust gas from said combustion device is received by said emissions control device.

5. A device for heating exhaust gas from the combustion of fossil fuel upstream of an emissions control device, comprising:

a first conduit in which said emissions control device is disposed;

a second conduit that is adapted to receive an exhaust gas flow, wherein said second conduit is disposed upstream of, and in fluid communication with, said first conduit;

a flow straightener disposed in said second conduit, wherein said flow straightener is provided with a plurality of parallel channels, wherein said flow straightener extends over a portion of a cross-sectional area of said second conduit, and wherein at least a portion of said exhaust gas flow flows through said flow straightener;

a baffle arrangement disposed between said flow straightener and a wall of said second conduit;

a means for supplying fuel to said exhaust gas flow in said second conduit; and an ignition means disposed in said second conduit between said flow straightener and said emissions control device for igniting said fuel to produce a flame to heat said exhaust gas flow, wherein no secondary supply of gas that contains oxygen is provided to said exhaust gas flow or to said second conduit.

6. A device according to claim 5, wherein said flow straightener extends substantially over the entire cross-sectional area of said second conduit.

7. A device according to claim 5, wherein said flow straightener is spaced from said emissions control device to form a space.

8. A device according to claim 5, wherein said emissions control device is a particulate filter, either catalyzed or non-catalyzed, a Selective Catalytic Reduction device, or an $NO_x$ adsorber device.

9. A device according to claim 5, wherein a third conduit is provided for supplying an exhaust gas flow to said second conduit, and wherein said second conduit has a diameter that is greater than a diameter of said third conduit.

10. A device according to claim 1, wherein said exhaust gas flow is produced by a combustion device, and wherein said second conduit receives all of said exhaust gas flow from said combustion device.

11. A device according to claim 5, wherein said flow straightener is provided with 10-900 cpsi.

12. A device according to claim 11, wherein said flow straightener is provided in the form of a spiral-wound or sintered metal substrate.

13. A device according to claim 5, wherein said ignition means extends into said space.

14. A device according to claim 13, wherein said means for supplying fuel is disposed in the vicinity of said ignition means.

15. A device according to claim 14, wherein said means for supplying fuel includes at least one nozzle.

16. A device according to claim 14, wherein said ignition means includes at least one glow stick igniter, glow plug, or spark igniter.

* * * * *